US010293405B2

(12) United States Patent
Fu et al.

(10) Patent No.: US 10,293,405 B2
(45) Date of Patent: May 21, 2019

(54) CASTING AND MOLDING EQUIPMENT AND METHOD OF MANUFACTURING AMORPHOUS ALLOY STRUCTURAL UNIT

(71) Applicant: DONGGUAN EONTEC CO., LTD., Dongguan (CN)

(72) Inventors: Huameng Fu, Dongguan (CN); Haifeng Zhang, Dongguan (CN); Aimin Wang, Dongguan (CN); Zhengwang Zhu, Dongguan (CN); Hongwei Zhang, Dongguan (CN); Hong Li, Dongguan (CN); Yangde Li, Dongguan (CN); Weirong Li, Dongguan (CN); Tiezhuang Tang, Dongguan (CN)

(73) Assignee: DONGGUAN EONTEC CO., LTD., Dongguan (CN)

( * ) Notice: Subject to any disclaimer, the term of this patent is extended or adjusted under 35 U.S.C. 154(b) by 435 days.

(21) Appl. No.: 15/166,303

(22) Filed: May 27, 2016

(65) Prior Publication Data

US 2016/0271689 A1 Sep. 22, 2016

Related U.S. Application Data

(63) Continuation-in-part of application No. PCT/CN2014/085326, filed on Aug. 27, 2014.

(30) Foreign Application Priority Data

Nov. 30, 2013 (CN) ..... 2013 1 0639470

(51) Int. Cl.
*B22D 21/02* (2006.01)
*B22D 17/02* (2006.01)
(Continued)

(52) U.S. Cl.
CPC ..... *B22D 21/02* (2013.01); *B22D 17/002* (2013.01); *B22D 17/02* (2013.01); *B22D 17/04* (2013.01);
(Continued)

(58) Field of Classification Search
CPC ..... B22D 21/02; B22D 17/02; B22D 17/002; B22D 17/04; B22D 17/10; B22D 17/145;
(Continued)

(56) References Cited

U.S. PATENT DOCUMENTS 5,592,984 A * 1/1997 Schmiedeknecht .. B22D 27/045 164/120
2003/0051851 A1* 3/2003 Yamada ..... B22D 17/007 164/113
(Continued)

FOREIGN PATENT DOCUMENTS

JP 61106220 A * 5/1986 ..... B29C 45/586

*Primary Examiner* — Kevin P Kerns
*Assistant Examiner* — Steven S Ha
(74) *Attorney, Agent, or Firm* — Matthias Scholl P.C.; Matthias Scholl

(57) ABSTRACT

A casting and molding equipment for producing an amorphous alloy structural unit, including an injection system, an alloy melting system, a material feeding system, a mold system, a vacuum system, and a protective gas supply system. The injection system includes an injection tube, an injection mechanism, and a plunger rod; the plunger rod is adapted to move along an inner wall of the injection tube, and the injection mechanism is configured to control a moving direction and moving speed of the plunger rod. The alloy melting system includes a melting chamber and a heating unit; the heating unit is configured to melt an alloy material in the melting chamber; the heating unit includes an induction coil or resistance wire; the melting chamber is disposed in the injection tube, and the heating unit is disposed out of the injection tube.

8 Claims, 1 Drawing Sheet

(51) Int. Cl.

| | |
|---|---|
| ***B22D 17/04*** | (2006.01) |
| ***B22D 25/06*** | (2006.01) |
| ***B22D 17/00*** | (2006.01) |
| ***B22D 17/10*** | (2006.01) |
| ***B22D 17/14*** | (2006.01) |
| ***B22D 17/20*** | (2006.01) |
| ***B22D 17/22*** | (2006.01) |
| ***B22D 17/26*** | (2006.01) |
| ***B22D 17/28*** | (2006.01) |
| ***B22D 17/30*** | (2006.01) |
| ***B22D 27/00*** | (2006.01) |
| ***B22D 27/15*** | (2006.01) |
| ***F27D 11/06*** | (2006.01) |

(52) U.S. Cl.
CPC ..... *B22D 17/10* (2013.01); *B22D 17/145* (2013.01); *B22D 17/203* (2013.01); *B22D 17/2227* (2013.01); *B22D 17/263* (2013.01); *B22D 17/28* (2013.01); *B22D 17/30* (2013.01); *B22D 25/06* (2013.01); *B22D 27/003* (2013.01); *B22D 27/15* (2013.01); *F27D 11/06* (2013.01)

(58) Field of Classification Search
CPC ..... B22D 17/203; B22D 17/2227; B22D 17/263; B22D 17/28; B22D 17/30; B22D 17/15; B22D 25/06; B22D 27/003
See application file for complete search history.

(56) References Cited

U.S. PATENT DOCUMENTS

| | | | | |
|---|---|---|---|---|
| 2006/0278362 | A1* | 12/2006 | Muramatsu ..... | B22D 17/14 164/312 |
| 2010/0252222 | A1* | 10/2010 | Baumgartner ..... | B22C 9/067 164/113 |
| 2014/0090799 | A1* | 4/2014 | Waniuk ..... | B22D 17/04 164/493 |

* cited by examiner

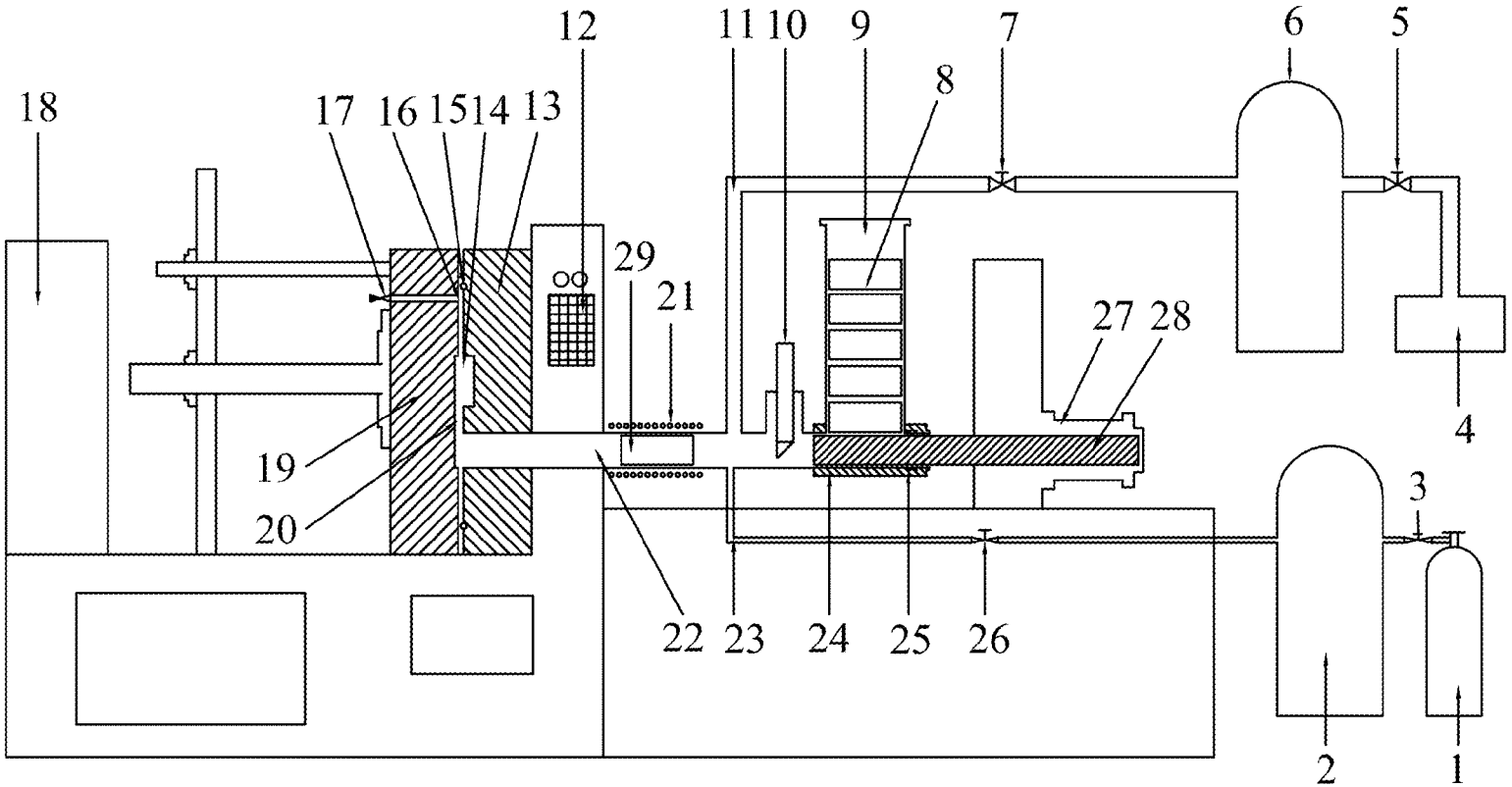
1
2
3
4
5
6
7
8
9
10
11
12
13
14
15
16
17
18
19
20
21
22
23
24
25
26
27
28
29

CASTING AND MOLDING EQUIPMENT AND METHOD OF MANUFACTURING AMORPHOUS ALLOY STRUCTURAL UNIT

CROSS-REFERENCE TO RELATED APPLICATIONS

This application is a continuation-in-part of International Patent Application No. PCT/CN2014/085326 with an international filing date of Aug. 27, 2014, designating the United States, now pending, and further claims priority benefits to Chinese Patent Application No. 201310639470.8 filed Nov. 30, 2013. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to a casting and molding equipment and a method of manufacturing an amorphous alloy structural unit using the same.

Description of the Related Art

Typically, the casting equipment of amorphous alloy structural unit includes an alloy melting unit and an injection tube which are disposed in a large vacuum chamber and a protective gas-filled chamber, respectively. In practice, after each molding process, the vacuum environment is destroyed, or the protective gas is discharged, both of which must be reestablished for next cycle, thus prolonging the production cycle and reducing the production efficiency.

In addition, the die cavity of the casting equipment contains no vent holes, and thus gas holes or shrinkage holes tend to form on the surface of the amorphous alloy, thereby reducing the product quality.

SUMMARY OF THE INVENTION

In view of the above-described problems, it is one objective of the invention to provide a casting and molding equipment and a method of manufacturing an amorphous alloy structural unit using the same. The equipment and method have high mold efficiency and the molded products have high quality.

To achieve the above objective, in accordance with one embodiment of the invention, there is provided a casting and molding equipment for producing an amorphous alloy structural unit, comprising an injection system, an alloy melting system, a material feeding system, a mold system, a vacuum system, and a protective gas supply system.

The injection system comprises an injection tube, an injection mechanism, and a plunger rod; the plunger rod is adapted to move along an inner wall of the injection tube, and the injection mechanism is configured to control a moving direction and moving speed of the plunger rod.

The alloy melting system comprises a melting chamber and a heating unit; the heating unit is configured to melt an alloy material in the melting chamber; the heating unit comprises an induction coil or resistance wire; the melting chamber is disposed in the injection tube, and the heating unit is disposed out of the injection tube.

The material feeding system comprises a material tank and a transition chamber; the alloy material is stored in the material tank; the transition chamber is a tubular structure having two open ends; the plunger rod is adapted to slide in the transition chamber; the material tank is disposed on the transition chamber and communicates with the transition chamber.

The mold system comprises a fixed die, a seal ring, a moving die, a die cavity, an exhaust channel, a constant pressure one-way valve, a pouring channel, and a mold opening and closing mechanism; the mold opening and closing mechanism is configured to control the opening and closing of the fixed die and the moving die; the closing of the fixed die and the moving die generates the die cavity; the die cavity communicates with the injection tube via the pouring channel; the die cavity communicates with external environment via the exhaust channel; the constant pressure one-way valve is disposed at one end of the exhaust channel; and the fixed die and the moving die are sealed by the seal ring.

The vacuum system comprises a vacuum unit and a vacuum tank; the vacuum unit is connected to the vacuum tank via a second valve; the vacuum tank is connected to the injection tube via a vacuum connecting pipe on which a third valve is disposed; and a joint of the vacuum tank and the injection tube is located between the melting chamber and the transition chamber.

The protective gas supply system a protective gas tank and a gas storage tank connected to the protective gas tank; the gas storage tank is connected to the injection tube via a gas tube on which a fourth valve is disposed; and a pipeline connecting the protective gas tank and the gas storage tank is provided with a firs valve.

In a class of this embodiment, a telescopic observation window is disposed on the injection tube to monitor a molten state of the alloy material in the melting chamber.

In a class of this embodiment, the equipment further comprises a control plate configured to control the opening and closing of the fixed die and the moving die, a temperature of the heating unit, and the movement of the plunger rod.

In a class of this embodiment, the equipment is in use under vacuum or a positive pressure atmosphere.

In a class of this embodiment, the plunger rod is tightly coupled to the transition chamber via a seal washer.

In a class of this embodiment, the telescopic observation window comprises a triple prism for monitoring the molten state of the alloy material.

In a class of this embodiment, the protective gas tank is filled with inert gas.

In a class of this embodiment, the equipment adopts an induction heating mode, the injection tube corresponding to the heating unit is made of ceramic material, graphite, temperature resistant material, or paramagnetic material having a ceramic coating.

In a class of this embodiment, the constant pressure one-way valve is disposed on the fixed die and/or moving die, and a number of the constant pressure one-way valve is one or more according to design requirement.

In accordance with another embodiment of the invention, there is provided a method for casting and molding an amorphous alloy structural unit using the casting and molding equipment, the method comprising:

1) tightly coupling the fixed die and the moving die via the seal ring, disposing the constant pressure one-way valve on the exhaust channel, to yield the die cavity which is sealed;
2) opening the second valve and starting the vacuum unit to vacuumize the vacuum tank; opening the third valve and vacuumizing the die cavity, the injection tube, and the material tank; when the casting and molding equipment is required to work under vacuum, then proceed to next step; when the casting and molding equipment is required to work under a positive pressure atmosphere, opening the first valve and inflating the gas storage tank with a protective gas, and then opening the fourth valve, inflating the die cavity, the injection tube, and the material tank with the protective gas to reach a pressure, adjusting the pressure by the constant pressure one-way valve;

3) loading the material tank with the alloy material;

4) dragging the plunger rod to leave an original position thereof so that the alloy material falls into the transition chamber due to action of gravity, pushing the plunger rod to convey the alloy material to the melting chamber, and then dragging the plunger rod to be away from the heating unit;

5) dropping the observation window;

6) starting the heating unit and fully melting the alloy material, lifting the observation window, pushing the plunger rod to drive molten alloy material to pass the pouring channel and enter the die cavity; opening the constant pressure one-way valve to discharge surplus gas when the die cavity is about to be filled in;

7) molding the molten alloy material in the die cavity, cooling, inflating the die cavity with external gas via the gas tube to balance a gas pressure in the die cavity, opening the die cavity and collecting a mold; and 8) repeating above steps for a next cycle.

In a class of this embodiment, the vacuumization of the vacuum tank by the vacuum unit is only performed in an initial cycle, or the opening of the first valve and the inflation of the gas storage tank with the protective gas are only performed in an initial cycle.

In a class of this embodiment, when the casting and molding equipment is working under vacuum, a vacuum degree is $10^{-2}$ Pascal.

In a class of this embodiment, when the casting and molding equipment is working under a positive pressure atmosphere, the protective gas has a pressure of between 1 and 1.5 atmospheric pressure.

The casting and molding equipment of the invention is adapted to prepare the amorphous alloy structural unit including but not limited to Zr-based amorphous alloy, Ti-based amorphous alloy, Fe-based amorphous alloy, Ni-based amorphous alloy, Al-based amorphous alloy, Mg-based amorphous alloy, Cu-based amorphous alloy, and can also be practicable to preparation of active metal components such as Ti alloy, Al alloy, and Mg alloy.

The principle of the invention is summarized as follows. The melting system and the injection system are efficiently incorporated in the casting and molding equipment, thus simplifying the structure of the casting and molding equipment, saving the space requirement for the vacuum protection or protective atmosphere, shortening the vacuumization time, and saving the usage amount of protective gas. The vacuum tanks and the gas storage tank are introduced to the vacuum system or the protective gas supply system, so that during melting, demolding and molding, the vacuum tank can be vacuumized and the gas storage tank can be filled with protective gas in advance, thus saving the production time and improving the production efficiency of each production cycle. In addition, the casting and molding equipment has compact and simple structure, low maintenance cost, and is practicable to continuous automatic production.

The casting and molding equipment is particularly practicable to the preparation of an amorphous alloy structural unit. The preparation of the amorphous alloy structural unit can be performed under vacuum or in the positive pressure protective gas atmosphere, and the space requiring the vacuum protection or protective atmosphere is small. The arrangement of the exhaust channel on the mold can prevent the formation of micro shrinkage holes on the surface of the alloy structural unit, thus improving the product quality. The high vacuum tank or the protective gas tank can continuously produce the vacuum environment or the protective gas source, thus ensuring the steady molding conditions, shortening the production cycle, saving the production cost, and improving the production efficiency.

Advantages of the casting and molding equipment and a method of manufacturing an amorphous alloy structural unit using the same according to embodiments of the invention are summarized as follows.

1. The casting and molding equipment has compact and simple structure, and the space requiring the vacuum protection or protective atmosphere is small, thus shortening the vacuumization time, and saving the usage amount of protective gas.

2. The casting and molding equipment comprises a material feeding system, thus ensuring the persistent supply of the raw material.

3. The production cycle for molding the amorphous alloy structural unit is reduced, and the production efficiency is improved.

4. The casting and molding equipment has low maintenance cost, and is practicable for continuous automatic production.

BRIEF DESCRIPTION OF THE DRAWINGS

The invention is described hereinbelow with reference to accompanying drawings, in which the sole FIGURE is a schematic diagram of a casting and molding equipment for producing an amorphous alloy structural unit in accordance with one embodiment of the invention.

In the drawings, the following reference numbers are used: 1. Protective gas tank; 2. Gas storage tank; 3. First valve; 5. Second valve; 7. Third valve; 26. Fourth valve; 4. Vacuum unit; 6. Vacuum tank; 8. Alloy material; 9. Material tank; 10. Telescopic observation window; 11. Vacuum connecting pipe; 12. Control plate; 13. Fixed die; 14. Die cavity; 15. Seal ring; 16. Exhaust channel; 17. Constant pressure one-way valve; 18. Mold opening and closing mechanism; 19. Moving die; 20. Pouring channel; 21. Heating unit; 22. Injection tube; 23. Gas tube; 24. Transition chamber; 25. Seal washer; 27. Injection mechanism. 28. Plunger rod; 29. Melting chamber.

DETAILED DESCRIPTION OF THE EMBODIMENTS

For further illustrating the invention, experiments detailing a casting and molding equipment and a method of manufacturing an amorphous alloy structural unit using the same are described below. It should be noted that the following examples are intended to describe and not to limit the invention.

As shown in the sole FIGURE, the invention provides a casting and molding equipment for producing an amorphous alloy structural unit, comprising an injection system, an alloy melting system, a material feeding system, a mold system, a vacuum system, and a protective gas supply system.

Specifically, the injection system comprises an injection tube 22, an injection mechanism 27, and a plunger rod 28, the plunger rod 28 is adapted to move along an inner wall of the injection tube 22, the injection mechanism 27 is configured to control a moving direction and moving speed of the plunger rod 28.

The alloy melting system comprises a melting chamber 29 and a heating unit 21; the heating unit 21 is configured to melt an alloy material 8 in the melting chamber 29; the heating unit 21 comprises an induction coil or resistance wire; the melting chamber 29 is disposed in the injection tube 22, and the heating unit 21 is disposed out of the injection tube 22. When the equipment adopts an induction heating mode, the injection tube 22 corresponding to the heating unit is made of ceramic material, graphite, temperature resistant material, or paramagnetic material having a ceramic coating. Preferably, a telescopic observation window is disposed on the injection tube 22 to monitor a molten state of the alloy material in the melting chamber 29. The telescopic observation window comprises a triple prism for monitoring the molten state of the alloy material.

The material feeding system comprises a material tank 9 and a transition chamber 24; the alloy material is stored in the material tank 9; the transition chamber 24 is a tubular structure having two open ends; the plunger rod 28 is adapted to slide in the transition chamber 24; the material tank 9 is disposed on the transition chamber 24 and communicates with the transition chamber 24.

The mold system comprises a fixed die 13, a seal ring 15, a moving die 19, a die cavity 14, an exhaust channel 16, a constant pressure one-way valve 17, a pouring channel 20, and a mold opening and closing mechanism 18; the mold opening and closing mechanism 18 is configured to control the opening and closing of the fixed die 13 and the moving die 19; the closing of the fixed die 13 and the moving die 19 generates the die cavity 14; the die cavity 14 communicates with the injection tube 22 via the pouring channel 20; the die cavity 14 communicates with external environment via the exhaust channel 16; the constant pressure one-way valve 17 is disposed at one end of the exhaust channel 16; and the fixed die 13 and the moving die 19 are sealed by the seal ring 15. The constant pressure one-way valve 17 is disposed on the fixed die and/or moving die, and a number of the constant pressure one-way valve 17 is one or more according to design requirement.

The vacuum system comprises a vacuum unit 4 and a vacuum tank 6; the vacuum unit 4 is connected to the vacuum tank 6 via a second valve 5; the vacuum tank 6 is connected to the injection tube 22 via a vacuum connecting pipe 11 on which a third valve 7 is disposed; and a joint of the vacuum tank 6 and the injection tube 22 is located between the melting chamber 29 and the transition chamber 24.

The protective gas supply system a protective gas tank 1 and a gas storage tank 2 connected to the protective gas tank 1; the gas storage tank 2 is connected to the injection tube 22 via a gas tube 23 on which a fourth valve 26 is disposed; and a pipeline connecting the protective gas tank 1 and the gas storage tank 2 is provided with a firs valve 3.

The casting and molding equipment further comprises a control plate 12 configured to control the opening and closing of the fixed die 13 and the moving die 19, a temperature of the heating unit 21, and the movement of the plunger rod 28.

A method for casting and molding an amorphous alloy structural unit using the casting and molding equipment, comprises the following steps:

1) tightly coupling the fixed die 13 and the moving die 19 via the seal ring 15, disposing the constant pressure one-way valve 17 on the exhaust channel 16, to yield the die cavity 14 which is sealed;
2) opening the second valve 5 and starting the vacuum unit 4 to vacuumize the vacuum tank 6; opening the third valve 7 and vacuumizing the die cavity 14, the injection tube 22, and the material tank 9; when the casting and molding equipment is required to work under vacuum, then proceed to next step; when the casting and molding equipment is required to work under positive pressure atmosphere, opening the first valve 3 and inflating the gas storage tank 2 with a protective gas, and then opening the fourth valve 26, inflating the die cavity 14, the injection tube 22, and the material tank 9 with the protective gas to reach a pressure, adjusting the pressure by the constant pressure one-way valve 17;
3) loading the material tank 9 with the alloy material 8;
4) dragging the plunger rod 28 to leave an original position thereof so that the alloy material 8 falls into the transition chamber 24 due to action of gravity, pushing the plunger rod 28 to convey the alloy material to the melting chamber 29, and then dragging the plunger rod 28 to be away from the heating unit 21;
5) dropping the observation window 10;
6) starting the heating unit 21 and fully melting the alloy material, lifting the observation window 10, pushing the plunger rod 28 to drive molten alloy material to pass the pouring channel 20 and enter the die cavity 14; opening the constant pressure one-way valve 17 to discharge surplus gas when the die cavity is about to be filled in 7;
7) molding the molten alloy material in the die cavity 14, cooling, inflating the die cavity with external gas via the gas tube 23 to balance a gas pressure in the die cavity, opening the die cavity and collect a mold; and
8) repeating above steps for a next cycle.

The vacuumization of the vacuum tank 6 by the vacuum unit 4 is only performed in an initial cycle, or the opening of the first valve 3 and the inflation of the gas storage tank with the protective gas are only performed in an initial cycle.

In the method, when the casting and molding equipment is working under vacuum, a vacuum degree is $10^{-2}$ Pascal.

In the method, when the casting and molding equipment is working under positive pressure atmosphere, the protective gas has a pressure of between 1 and 1.5 atmospheric pressure.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A casting and molding equipment for producing an amorphous alloy structural unit, the equipment comprising:

an injection system;

an alloy melting system;

a material feeding system;

a mold system;

a vacuum system; and a protective gas supply system;

wherein:

the injection system comprises an injection tube, an injection mechanism, and a plunger rod; the plunger rod is adapted to move along an inner wall of the injection tube, and the injection mechanism is configured to control a moving direction and moving speed of the plunger rod;

the alloy melting system comprises a melting chamber and a heating unit; the heating unit is configured to melt an alloy material in the melting chamber; the heating unit comprises an induction coil or resistance wire; the melting chamber is disposed in the injection tube, and the heating unit is disposed out of the injection tube;

the material feeding system comprises a material tank and a transition chamber; the alloy material is stored in the material tank; the transition chamber is a tubular structure having two open ends; the plunger rod is adapted to slide in the transition chamber; the material tank is disposed on the transition chamber and communicates with the transition chamber;

the mold system comprises a fixed die, a seal ring, a moving die, a die cavity, an exhaust channel, a constant pressure one-way valve, a pouring channel, and a mold opening and closing mechanism; the mold opening and closing mechanism is configured to control the opening and closing of the fixed die and the moving die; the closing of the fixed die and the moving die generates the die cavity; the die cavity communicates with the injection tube via the pouring channel; the die cavity communicates with external environment via the exhaust channel; the constant pressure one-way valve is disposed at one end of the exhaust channel; and the fixed die and the moving die are sealed by the seal ring;

the vacuum system comprises a vacuum unit and a vacuum tank; the vacuum unit is connected to the vacuum tank via a second valve; the vacuum tank is connected to the injection tube via a vacuum connecting pipe on which a third valve is disposed; and a joint of the vacuum tank and the injection tube is located between the melting chamber and the transition chamber;

the protective gas supply system comprises a protective gas tank and a gas storage tank connected to the protective gas tank; the gas storage tank is connected to the injection tube via a gas tube on which a fourth valve is disposed; and a pipeline connecting the protective gas tank and the gas storage tank is provided with a first valve; and a telescopic observation window is disposed on the injection tube to monitor a molten state of the alloy material in the melting chamber.

2. The equipment of claim 1, further comprising a control plate configured to control the opening and closing of the fixed die and the moving die, a temperature of the heating unit, and the movement of the plunger rod.

3. The equipment of claim 1, being in use under vacuum or a positive pressure atmosphere.

4. The equipment of claim 1, wherein the plunger rod is coupled to the transition chamber via a seal washer.

5. The equipment of claim 1, wherein the telescopic observation window comprises a triple prism for monitoring the molten state of the alloy material.

6. The equipment of claim 1, wherein the protective gas tank is filled with inert gas.

7. The equipment of claim 1, adopting an induction heating mode, wherein the injection tube corresponding to the heating unit is made of ceramic material, graphite, temperature resistant material, or paramagnetic material having a ceramic coating.

8. The equipment of claim 1, wherein the constant pressure one-way valve is disposed on the fixed die and/or moving die, and a number of the constant pressure one-way valve is one or more.

* * * * *